US008303062B2

(12) United States Patent
Zanelli

(10) Patent No.: US 8,303,062 B2
(45) Date of Patent: Nov. 6, 2012

(54) METHOD AND INKJET PRINTER WITH AUTOMATIC COMPENSATION OF THE THICKNESS OF A PRINTABLE SUBSTRATE

(75) Inventor: Maurizio Zanelli, Brunate (IT)

(73) Assignee: Topconsulting SAGL, Rancate-Mendrisio (CH)

( * ) Notice: Subject to any disclaimer, the term of this patent is extended or adjusted under 35 U.S.C. 154(b) by 0 days.

(21) Appl. No.: 13/388,113

(22) PCT Filed: Aug. 6, 2010

(86) PCT No.: PCT/EP2010/061520

§ 371 (c)(1), (2), (4) Date: Apr. 13, 2012

(87) PCT Pub. No.: WO2011/015665

PCT Pub. Date: Feb. 10, 2011

(65) Prior Publication Data

US 2012/0188302 A1 Jul. 26, 2012

(30) Foreign Application Priority Data

Aug. 7, 2009 (IT) ..... MI2009A1449

(51) Int. Cl.
*B41J 25/308* (2006.01)
*B41J 3/00* (2006.01)
*B41J 2/01* (2006.01)

(52) U.S. Cl. ..... 347/8; 347/2; 347/4; 347/101

(58) Field of Classification Search ..... 347/8, 2, 347/4, 101

See application file for complete search history.

(56) References Cited

U.S. PATENT DOCUMENTS

| | | | | |
|---|---|---|---|---|
| 5,940,092 | A * | 8/1999 | Kashimura et al. | 347/8 |
| 6,059,391 | A | 5/2000 | Fulkerson et al. | |
| 6,095,628 | A | 8/2000 | Rhome | |
| 2002/0060728 | A1 | 5/2002 | Koizumi et al. | |
| 2004/0179081 | A1 | 9/2004 | Nimi et al. | |

OTHER PUBLICATIONS

International Search Report issued Nov. 16, 2010 in International (PCT) Application No. PCT/EP2010/061520.

Written Opinion issued Nov. 16, 2010 in International (PCT) Application No. PCT/EP2010/061520.

* cited by examiner

*Primary Examiner* — Julian Huffman

(74) *Attorney, Agent, or Firm* — Wenderoth, Lind & Ponack, L.L.P.

(57) ABSTRACT

The inkjet printer (10) includes a carriage for holding a substrate (T) to be printed, movably supported along a printing path. The carriage comprises a slidable tray having lateral edges (31') defining a reference printing plane, and a vertically movable support table (32) for the substrate (T) and a lifting device (33) conformed to move the support table (32) between an upper position above the lateral edges (31') of the tray (17) for positioning and removing the substrate (T), and a lowered position beneath the lateral edges (31') of the tray (17), in which the support table (32) and the substrate (T) are urged against a stop frame (18) removably connectable to the tray (17) to keep z printable surface of the substrate (T) in a printing plane defined by the lateral edges (31') of the tray (17).

10 Claims, 4 Drawing Sheets

METHOD AND INKJET PRINTER WITH AUTOMATIC COMPENSATION OF THE THICKNESS OF A PRINTABLE SUBSTRATE

BACKGROUND OF THE INVENTION

This invention relates to improvements to the inkjet printers normally used to reproduce pictures, drawings and/or writing on a printable surface of a substrate; for purposes of this description, the term "substrate" refers to any flat item or finished article including at least one inkjet printable surface, in any stiff or flexible fabric, plastic, glass, ceramic, metal or other material.

In particular, the invention relates both to an inkjet printer and a printing method in which use is made of an innovative carriage device for holding a substrate to be printed, which is conformed to simplify the positioning and removal operations of the printable substrate directly on a support table, allowing at the same time for an automatic thickness compensation of substrates of different types, and by which it is possible automatically to perform a positioning of the substrate or article to be printed on a preset printing plane, keeping the printing plane at a constant distance from an inkjet printing head, irrespective of the thickness of the substrate or the article itself, without having to perform specific or complicated adjustment operations.

For purposes of this description, the term "picture" refers to any drawing, photo, decoration, writing, logo or similar which may be printed by inkjet, in black and white and/or color, on a flat surface of a substrate, and in which the picture has been previously stored in a control unit of the inkjet printer.

Although the inkjet printer and the carriage for holding and moving the substrate have been designed and are described here, by way of example, for printing articles in fabric, such as T-shirts, sweatshirts, shirts, etc., it is not excluded of any possibility of conforming the carriage for supporting and printing on any other type of substrate, consisting for example, of a sheet of stiff or flexible material, a finished object of any type and material.

STATE OF THE ART

Currently, for printing pictures in black and white and/or color on a substrate, inkjet printers are used comprising a digital system in which a picture to be printed is previously stored in an electronic control unit.

Inkjet printing has replaced traditional printing techniques for some time now, due to the numerous advantages it allows in terms of speed, resolution and clarity of the image, and versatility of use. Use of inkjet printers for printing on fabric, clothes or other types of substrates, was proposed, for example, in U.S. Pat. Nos. 6,095,628, 6,059,391, US-A-2002/060728 and US-A-2004/179081.

In particular, U.S. Pat. No. 6,095,628 describes a programmable device for the reproduction of a decoration, drawing, writing or similar on a substrate of any nature, in which use is made of an inkjet printer including a support table for the substrate or article to be printed, which is moved along horizontal guides in a position beneath a inkjet printing head. The picture to be printed, which may include photos, drawings, words and/or logos, is programmed and stored in a memory of a control unit using standard or proprietary software.

According to the solution illustrated in this document, the support table for the substrate moves along a printing path on a horizontal surface, at a preset distance to a printing head; depending on the type of printable substrate and its geometric characteristics, it is necessary each time to use an adjustable support table in order to maintain unchanged the distance of the substrate from the printing head.

In practice, the thickness and characteristics of the substrate or item to be printed may change each time; in inkjet printing devices, it is therefore necessary to adjust the height of the support table for the substrate to be printed, in order to maintain basically unchanged the distance between the printable surface of the substrate and the inkjet head, as the thickness of the substrate changes, since, if this distance were not to be constant, the definition of the printed image would change, with a consequent reduction in the quality.

In order to remedy this problem, U.S. Pat. No. 6,059,391 suggests to adjust the height of the printing head, or the substrate support table, to maintain at a preset value the distance between the surface to be printed of the substrate and the inkjet printing head.

In a practical embodiment of the teachings of this document, the support table for the substrate longitudinally slides on a vertically movable support frame, which may be adjusted in height both manually and automatically through an appropriate actuator.

Although this solution allows a correct positioning of the printable substrate, compared with the inkjet printing head, on the basis of the thickness and characteristics of the substrate, in practise the solution is complex in terms of constructional features and working, since it requires considerable experience and manual skill of a specialised operator, as well as working times which, in certain cases, may be excessively long, with a consequent increase in costs and reduction of productivity.

US-A-2002/060728 discloses an inkjet printer adapted for printing on T-shirts, in which a T-shirt to be printed is clamped between a resiliently mounted support platen and frame members for retaining the table fastened to a transportation device. The document does not mention the problem of inkjet printing on substrates with differing thickness and easily positioning and removal of the substrate into an appropriate position, due to a fixed connection of said frame members to the same transportation device.

Lastly US-A-2004/179081 discloses the use of a substrate supporting table and a device for adjusting the position of the substrate in respect to the inkjet printing head; again no automatic comparison of thickness of substrate, maintaining a prefixed printing position of the substrate is made possible.

OBJECTS OF THE INVENTION

The main object of this invention is to provide an inkjet printer comprising a carriage device for supporting a substrate to be printed, which is conformed to allow a controlled positioning and removal of whatever substrate to be printed, automatically compensating any changes in thickness of the same substrate.

A further object is to provide an inkjet printer for the reproduction of pictures such as photos, images, drawings and/or writing on a printable surface of a substrate or article provided with a printable surface, in which use is made of a support table for the substrate by which any substrate to be printed in any material, shape and/or thickness, may be easily and correctly positioned in an extremely rapid mode, by simple manual operations performed by any operator.

A further object is to provide an inkjet printer and relative printing method, by which the operations of positioning and removal of the substrate to be printed from the carriage device may be performed outside and separately from the printer, while the printer is printing on a substrate positioned on another carriage device.

BRIEF DESCRIPTION OF THE INVENTION

According to the invention, an inkjet printer has been provided for reproduction of pictures on a printable surface of a substrate, comprising:

an inkjet printing head, transversally movable to a longitudinally extending printing path;

a carriage device for holding the substrate;

control means for moving the carriage device along the printing path; and a programmable electronic control unit operatively connected to the printing head and to the control means for the carriage device;

in which the carriage device comprises:

a slidable tray conformed with coplanary arranged reference edges defining a printing plane;

a table for supporting the substrate, vertically movable in respect to the slidable tray, characterised by comprising a lifting device for the support table, conformed to move the support table between an upper position above the reference edges of the slidable tray, and a lower position beneath said reference edges;

biasing means operatively connected to move the support table towards said upper position above the reference edges of the tray;

the carriage device also comprising a removable stop frame for the support table, and clamping means to disengageably connect the stop frame to the slidable tray to retain a printable surface of the substrate on the support table in correspondence of the printing plane.

A method for printing pictures on a printable surface of a substrate has been also provided in which the pictures to be printed are stored in a memory of an electronic control unit of an inkjet printer, in which the printer includes a carriage device having a tray and a support table as previously defined, for supporting the substrate, characterised by the steps of:

positioning a substrate to be printed on the support table of the carriage device, with the support table in a raised position above reference edges of the carriage device, providing a printing plane;

downwardly moving the support table with the substrate in a lowered position beneath said reference edges;

locking the support table and the substrate in the lowered position by a removable stop frame disengageably connected to the carriage device; and performing an inkjet printing on the substrate, by moving the carriage device along a printing path, maintaining the support table and the substrate urged against the stop frame.

BRIEF DESCRIPTION OF THE DRAWINGS

These and further characteristics and advantages of the inkjet printer, the support carriage device for the substrate and the printing method according to the invention will be more clearly evident from the following description, with reference to the examples of the accompanying figures, in which.

DETAILED DESCRIPTION OF THE INVENTION

Figure 1:
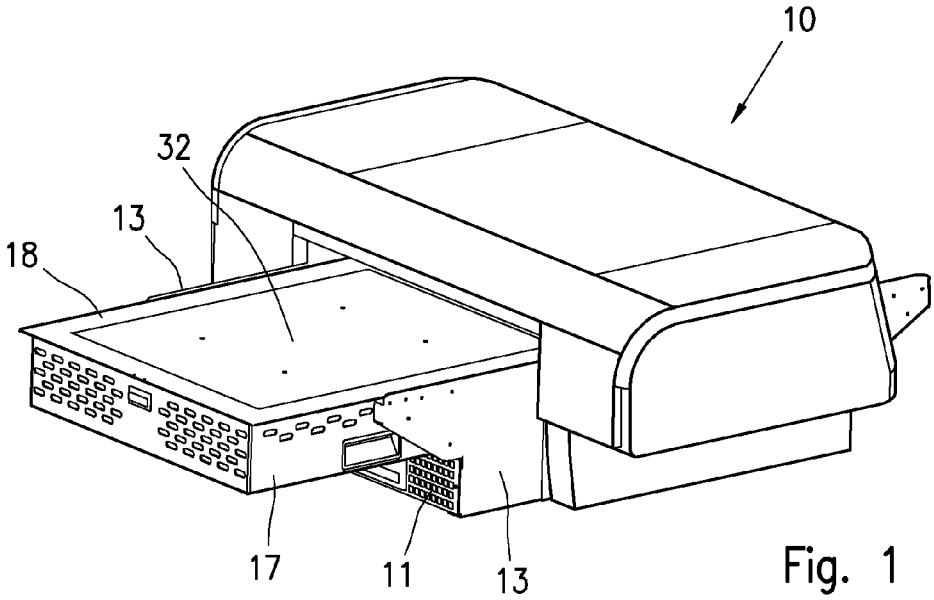
FIG. 1 is a perspective view of an inkjet printer, provided with a carriage device for supporting a printable substrate, according to the invention.
Figure 2:
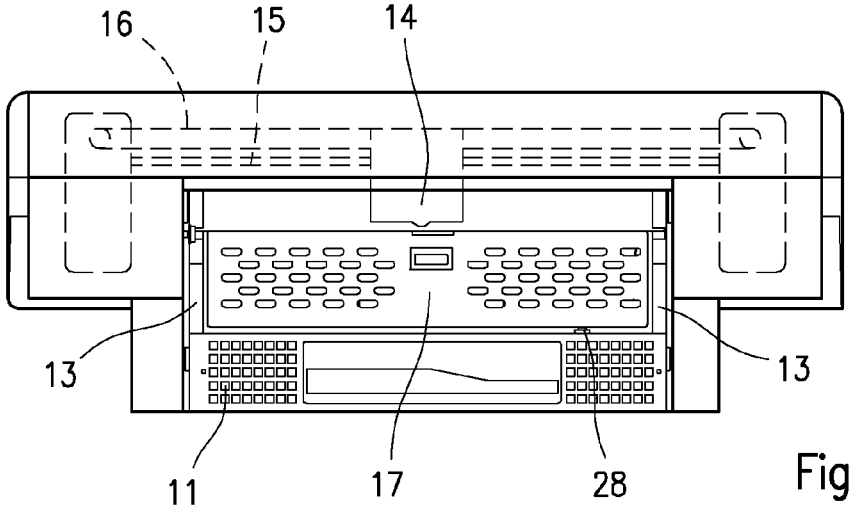
FIG. 2 is a front view of the printer in FIG. 1.

The essential characteristics of an inkjet printer, suitable for printing on a substrate, of any nature and type of material, will be described below by way of example, specifying that the inkjet printer may be of any kind and that the carriage device for supporting the printable substrate, which in the present case is exemplified schematically in the form of a box-shaped tray conformed to contain the support table the printable substrate and the lifting and thickness compensation device, may be of any kind, or may be differently shaped to the one shown, provided it is suitable to provide a fixed reference plane for the printable surface of the substrate, irrespective of the geometric characteristics, shape and/or thickness of the same substrate to be printed.

For purposes of this invention, the term "printable substrate" refers to any flat article or shaped item suitable to be printed by an inkjet printer, of any stiff or flexible material, as previously indicated, including finished objects with at least one flat printable surface.

An inkjet printer according to this invention, comprising a support carriage device for a printable substrate in the form of a box-shaped tray, will be described below by way of example and not limiting the invention and the numerous possible embodiments.

As shown in FIGS. 1 to 5, the inkjet printer, indicated in its entirety with 10, comprises a frame having a hollow base 11 provided with an upper surface 12, and side guide walls 13 which extend in a longitudinal direction of a printing path. Above the base 11 there is an inkjet printing head 14 which is movably supported in a manner known in itself, to reciprocate in both directions, transversally to the longitudinal direction of the surface 12; the printing head 14 runs along a guide bar 15 and is operatively connected to a drawing system schematically indicated at 16.

The base 11 is conformed to house an electronic control unit of the printer, not shown, which is programmable to store one or more pictures such as images, drawings and/or writing which must be reproduced on a surface of a suitable printable substrate, for example an article in textile, or other suitable material, or finished product, on the basis of a specific printing program.

The printer 10, in the case shown, comprises a carriage device for supporting a printable substrate, in the form of a box-shaped tray 17 which is moved in a controlled way along the printing path.

According to a preferential embodiment, tray 17, or more generally the carriage device for supporting the printable substrate, is suitable to be removed from one side of the printer 10; this allows even a non-expert operator to position and remove from the tray 17 a substrate to be printed extremely easily, operating at a workstation outside from the printer. A controlled forward and rearward movement of tray 17 with respect to the inkjet printing head 14, may be performed through any suitable drawing means, correlated to the movement of the printing head 14, since both are operatively connected to an electronic control unit of the printer.

In general terms, the carriage device or tray 17 for supporting the printable substrate comprises a base frame conformed with coplanar edges 31' suitable to provide a reference plane for a printable surface of a substrate; the carriage device also includes a support table 32 for holding a printable substrate, vertically mobile and conforming to a flat or finished shape of an article to be printed.

A lifting device 33 for the support table 32 is provided inside the tray 17 to move the support table 32 between a raised position above the reference edges 31' for the printing plane, and a lowered position beneath said edges 31', being clamped against the side edges 31' providing the printing reference plane.

A removably stop frame 18 provided with engageable and disengageable retaining means for retaining the stop frame fastened to the carriage device, maintains the support table and a substrate in a lowered position, with the printable surface of the substrate in correspondence with the printing plane. In this way, an easy positioning and removal of the substrate and an automatic compensation for substrates of different thicknesses is automatically obtained, maintaining unchanged the position of the printable surface.

In particular, with reference to the example shown, the tray 17 comprises a removable and an annularly shaped stop frame 18 for retaining the support table 32 in a lowered position, in which the frame 18 is provided with flat side wings 18' to rest on drawing belts 19 running along an upper edge of each side wall 13.

Figure 3:
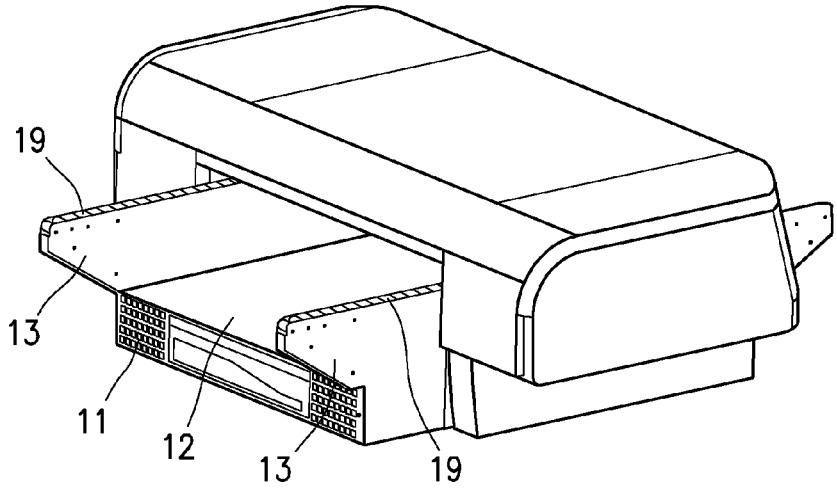
FIG. 3 is a perspective view of the printer, after the removal of the carriage device for the substrate.
Figure 4:
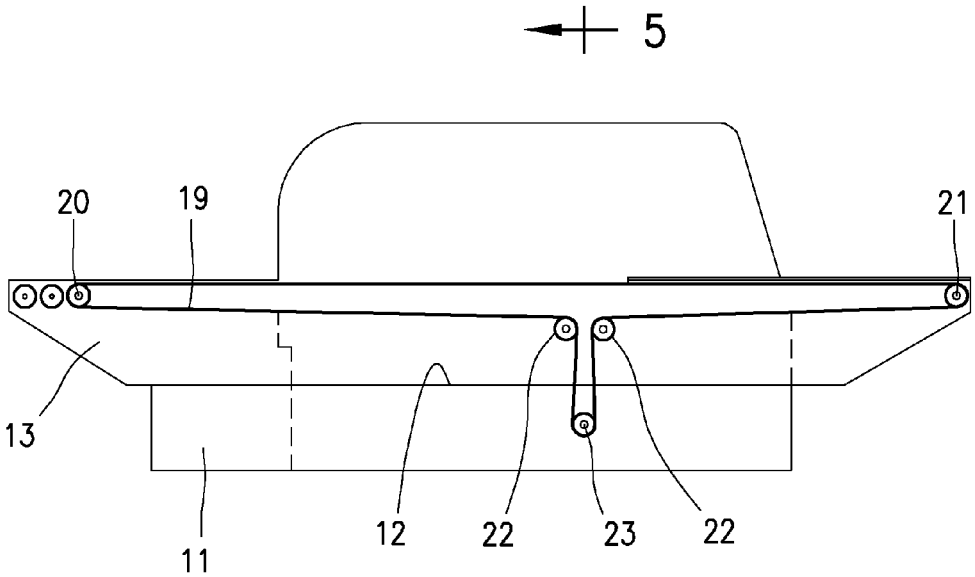
FIG. 4 is a schematic view showing a drawing system for moving the carriage device and the substrate in respect to an inkjet printing head.
Figure 5:
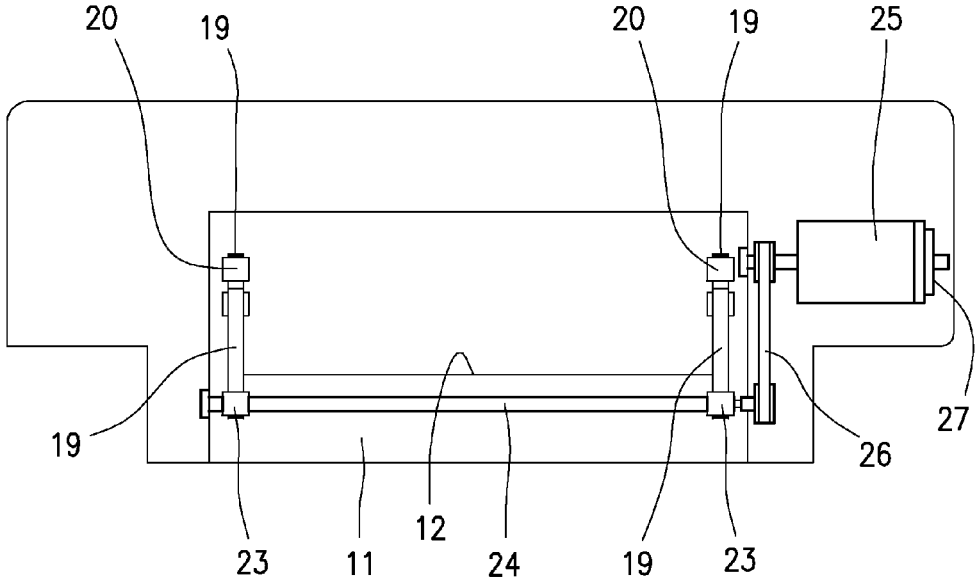
FIG. 5 is a schematic cross-sectional view according to line 5-5 of FIG. 4.

As schematically shown in FIGS. 3 and 4, each drawing belt 19 for the tray 17 runs along a guide surface, between a front idle roller 20, a rear idle roller 21 and intermediate idle roller 22, towards a lower drawing roller 23. The drawing rollers 23 of the two belts 19 are connected to a transversal shaft 24 in turn connected to an electric motor 25 via a belt 26, or in any other suitable way; lastly, reference number 27 indicates a signal generator, for example an encoder, to supply the electronic control unit of the printer with reference signals indicative of the position of the tray 17 along the printing path; a sensor 28, FIG. 2, supplies a control signal to the control unit indicative of the presence of tray 17.

Figure 6:
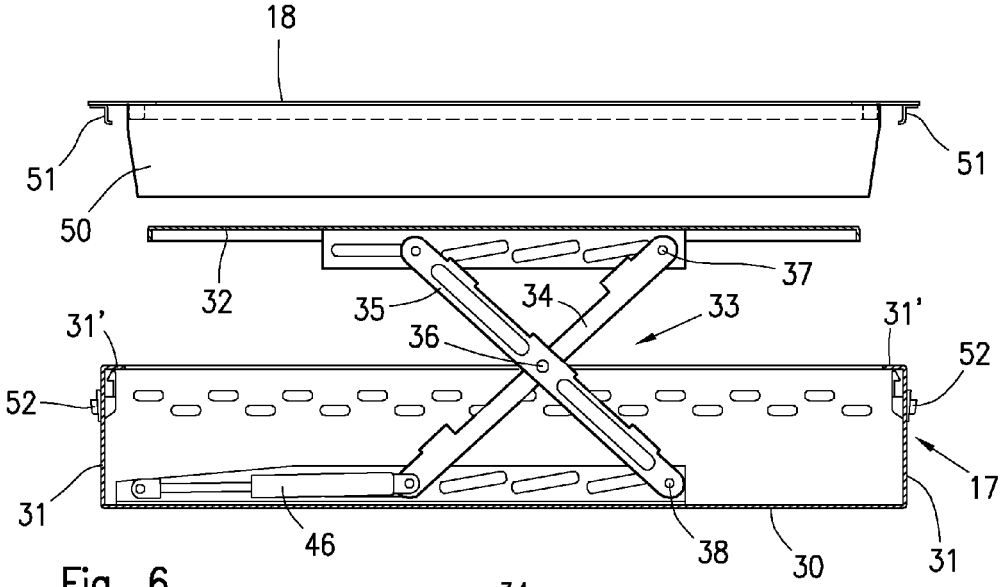
FIG. 6 is a longitudinal cross-sectional view, in the raised upper position, of the substrate support table.
Figure 7:
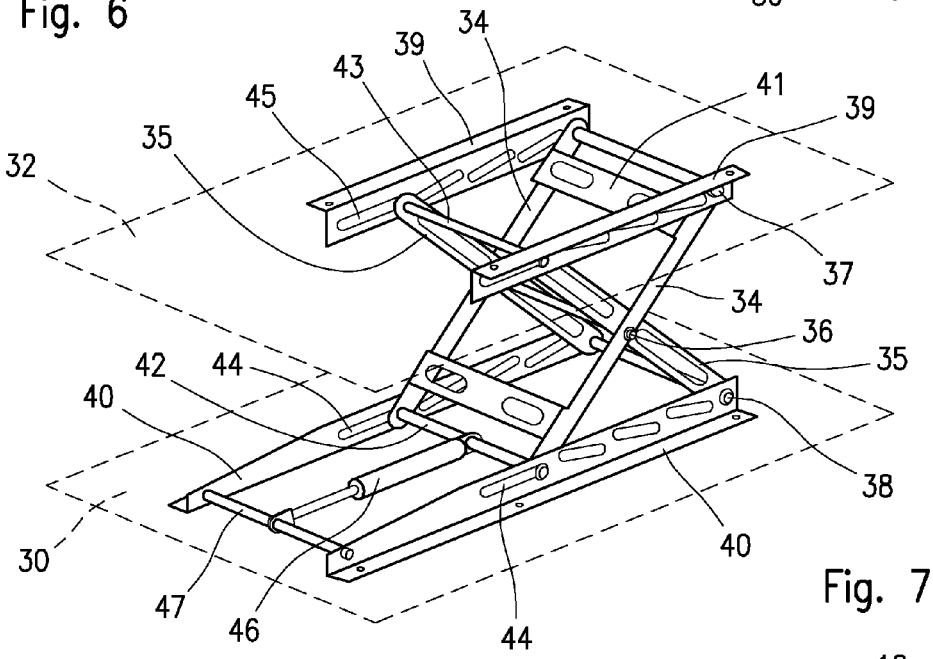
FIG. 7 is a perspective view of an embodiment of the lifting device for the substrate support table.
Figure 8:
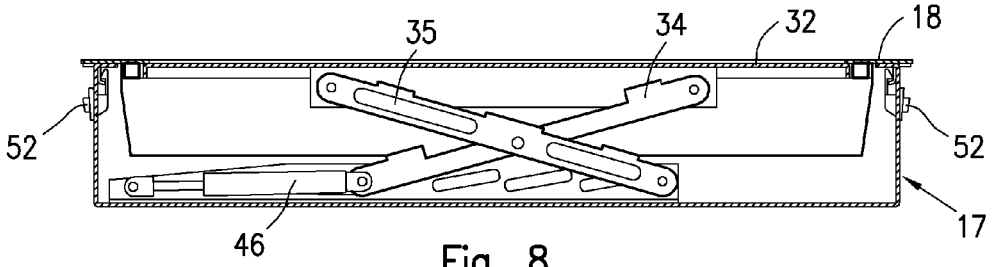
FIG. 8 is a view of the device in FIG. 6, in a lowered position of the support table.

A non-limitative embodiment of the carriage device for supporting a printable substrate is shown in FIGS. 6, 7, 8, and in the enlarged details of the remaining figures from 9 to 11.

In the example under consideration, the carriage device comprises a top-open box-shaped tray 17, having a bottom 30 and side walls 31 provided with inwardly bent edges 31' providing a reference printing plane; the carriage comprises also a flat support table 32 for holding a substrate or article to be printed, and a lifting device 33 conformed and elastically biased to vertically move table 32 between a lower position, underneath the reference edges 31' of tray for the printing plane, shown in FIG. 8, and a upper position raised above the reference edges 31', as shown in FIG. 6, to allow easy application on the table 32 of a substrate to be printed, respectively the removal of a printed substrate.

With particular reference to the example in FIG. 6, the lifting device 33 includes two articulated cross journals, operatively connected between the support table 32 and bottom 30 of tray 17.

It is specified that the carriage device for the substrate need not necessarily be in the form of the box-shaped tray shown in FIGS. 6 and 8, provided that the carriage device being conformed with a base frame having reference side edges 31' defining a printing plane in correspondence with which a printable surface of the substrate can be positioned. The side walls 31 and bottom 30 of tray 17 could therefore be replaced by a mesh, or by simple support elements for the lifting device 33 of table 32, connected to the base frame or the stop frame 18.

The lifting device 33 for the support table 32 may also be of any kind and shape.

In particular, in the example of the articulated cross journal device of FIG. 7, the support table 32 is in the form of a flat table; also, each cross journal includes two rods 34, 35 pivoted at an intermediate point to a cross axis 36; the upper end of each rod 34 is hinged in 37 to an angle iron or L-shaped element 39, fastened to table 32, respectively the lower end of each rod 35 is hinged at 38 to an angle iron 40 connected to the bottom 30 of tray 17; the rods of the two cross journals are connected by crosspieces 41 to jointly rotate around the articulation cross axis 36, between the upper position in FIG. 6 in which the support table 32 is urged above the reference edge 31' of the tray 17, and a lowered position of FIG. 8 in which the support table 32 is positioned beneath the edge 31', inside the tray 17 as explained in greater detail below.

The other end of each rod 34, 35 is hinged in turn to a cross bar 42, 43 sliding along guide slots 44, 45, which longitudinally extend in each angle iron 39 and 40. Biasing means such as a gas spring 46 or other elastic biasing means connected between bar 42 and a bar 47 which connects together the two lower angle irons 40, acts on the lifting device comprising the two articulated cross journals, to move the support table 32 for the printable substrate, vertically upwards in the totally raised position of FIGS. 6 and 7, or against the stop frame 18 clamped to the tray 17.

In the case shown, reference is made to a lifting device of cross journal type subject to gas spring 46 or elastic biasing means which automatically push the table 32 upwards.

However, raising and lowering of support table 32 may be automatically performed, or on command, with other lifting device different to the one shown. For example, as an alternative to the cross journal system 34, 35 with biasing spring 46, the support table 32 could be guided in its vertical movement, and the raising could take place directly via one or more springs, or with any linear actuator, of both the electromechanical type, for example a motorised screw, or elastomeric members, through linear sliding guides.

Figure 10:
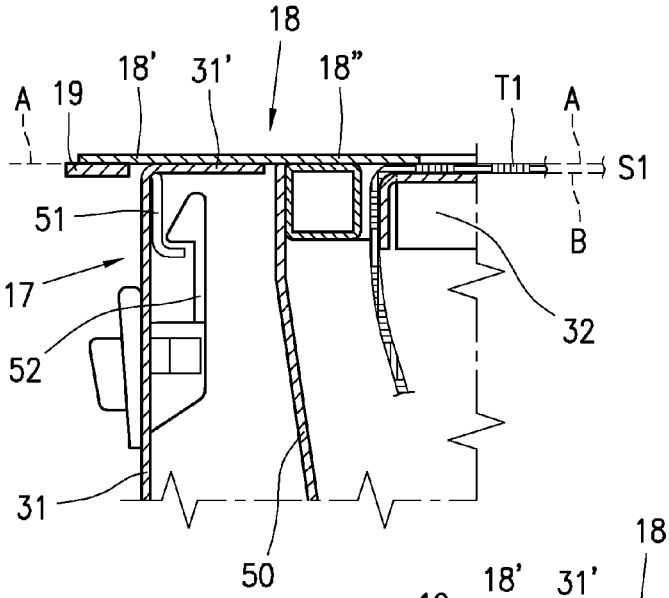
FIG. 10 is an enlarged detail similar to the one in FIG. 9, with the stop frame attached to the carriage device.
Figure 11:
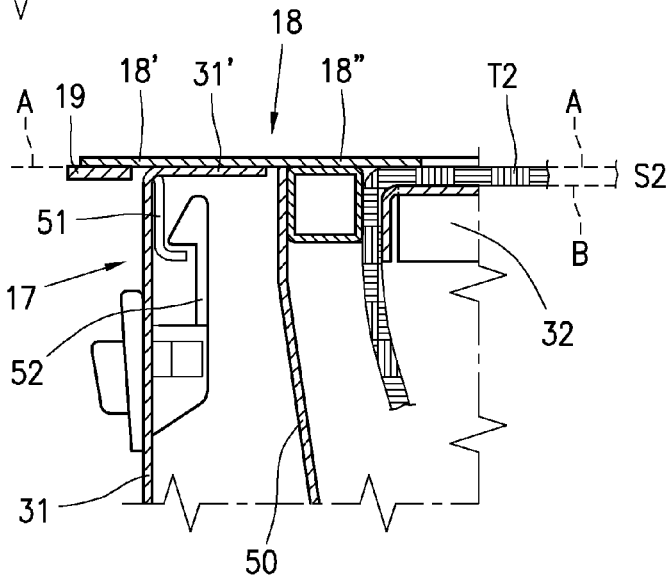
FIG. 11 is an enlarged detail similar to the one in FIG. 10, for a printable substrate having a thickness greater than the previous one.

Again according to the example being in consideration, as shown in FIG. 6 and in the enlarged detail of FIG. 10, the carriage device includes a removable stop frame 18 which may be clamped to the tray 17 to keep the printable substrate T stretched onto the support table 32, FIG. 10, in correspondence with the printing plane positioned at a preset height compared with printer head 14, irrespective of the thickness of the substrate.

As shown by the detail of FIG. 10, if the printable substrate T is an article in fabric or flexible material, of greater dimensions than the support table 32, the stop frame 18 may include an annular wall 50 downwardly extending inside the box-shaped body of tray 17; the annular wall 50 externally surrounds the table 32 to define a space for receiving the non-printable parts of a substrate T stretched on the support table 32; this assists dexterity of the operations for application and removal of the substrate, maintaining the latter in a perfectly stretched condition for the printing operation; naturally, the shape of stop frame 18 and support table 32 will depend on the flat or finished shape of the same substrate or article to be printed.

The removable stop frame 18, besides holding substrate T on the support table 32, preventing it interfering with the frame of the printer, performs important functions, specifically:

a) as previously stated, the upper edges 31' of the tray 17, contribute to defining a printing plane for the substrate T, while it is carried along the printing path of the inkjet printer;

b) conjointly to the lifting device 33, define a suitable position of the support table 32 with substrate T in correspondence with the printing plane, entirely independent of the thickness of the substrate itself;

c) also serve for resting the tray 17 of the carriage device against the belts 19 or other drawing means, during printing of the substrate.

The removable frame 18 therefore has external wings 18' to rest on the edges 31' of the tray 17, and an internal wings 18" which partially overlap with the peripheral edge of table 32 to stop it and hold the printable substrate T in a stretched condition with the printable upper surface of the same substrate T in correspondence with printing plane A. Through simple downwards pressure on frame 18, hooks 51 automatically engage with a clamping device 52, manually disengageable, at opposite side walls of tray 17, or more generally to the base frame of the carriage device.

The method of operation of inkjet printer 10 and support and carriage device 17 for the substrate T to be printed, is the following: the tray 17 is initially removed, from the printer 10, to be positioned on a working surface; manually acting on the clamping devices 52, an operator disengages the frame 18, which therefore may be removed.

Figure 9:
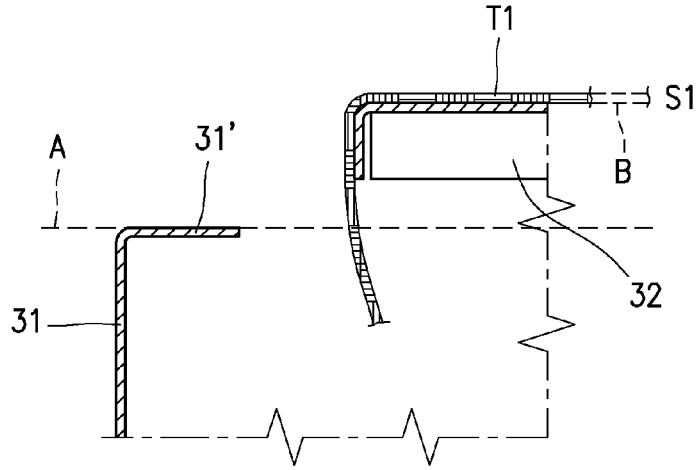
FIG. 9 is an enlarged detail of FIG. 6, showing the positioning on the support table of a first printable substrate with a relatively low thickness, and the stop frame removed.

Once the frame 18 is removed, the lifting device 33 pushes the table 32 upwards, beyond upper edge 31' of the tray 17, as shown in FIGS. 6 and 9, in which surface B of support table 32 for the substrate T1 is positioned at an appropriate height above the printing plane A.

At this point, the operator may position on the table 32 a substrate T1 having a certain thickness S1, as shown in FIG. 9. This operation may be easily performed in an extremely rapid mode, by a non-expert operator also, since the operator can work with the tray 17 totally removed from printer 10.

After having positioned the substrate T1 on the support table 32, the operator applies the frame 18 threading the annular wall 50 in the space between the edges of the table 32 and the walls 31 of tray 17 in a manner that part of substrate T1 to be printed is held on table 32 in a perfectly stretched condition, whereas the remaining part of the substrate T1, which must not be printed, is pushed inside the box-shaped body of tray 17, appropriately protected by the wall 50.

By pushing on frame 18 until it rests against the upper edge 31' of tray 17, the operator simultaneously pushes table 32 and substrate T1 downwards, due to yielding of lifting device 33, overcoming the reaction of the gas spring 46. In this way, the upper surface B of table 32 lowers below the surface A, by a space equal to the thickness S1 of substrate T1 to be printed; at this point, the frame 18 engages the clamping devices 52 to hold the table 32 and substrate T1 at the correct printing plane.

The tray 17 may now be positioned in the printer, with the external wings 18' of the frame 18 resting on the two drawing belts 19. When a start signal is given to the printer and a zero position detected, the printing operation may take place as usual, while tray 17 is entrained and advances along the printing path according to an operative method programmed and stored in the electronic control unit.

When printing step is completed, the tray 17 may be again removed from the printer and positioned once again on a working surface, so as the operator may remove the printed substrate T1 after disengaging the frame 18. The tray 17 at this point may therefore be reused for a second or further printing operations on the same or different types of substrates. Providing several trays 17, during a printing phase the operator may dispose other substrates T1 on separate trays 17, or carriage devices already ready to be introduced into the printer. In this way, the positioning operations of substrates to be printed, and removal of printed substrates may be performed separately, while printing of a substrate is in progress; the operative cycle times of the printer are therefore considerably reduced.

An inkjet printer comprising a carriage device for supporting a printable substrate according to the invention is therefore extremely advantageous in functional terms, since it allows operation with different types of printable substrates, automatically compensating any differences in thickness, and also in financial terms, since it is particularly suitable in cases in which printing of a limited number of articles of a different type, and/or with different drawings, is required.

In fact, again with reference to the drawings, let us now suppose that it is necessary to print a substrate T2 with greater thickness S2, for example twice S1; in this case, operations are performed as described previously, with the sole difference that the support table 32 will be automatically pushed downward for a greater length depending on the greater thickness S2, as shown in FIG. 10, keeping completely unchanged the position of the upper printable surface of substrate T2 compared to the printing plane A.

From what has been stated and shown in the examples in the attached drawings, it will be clear that an inkjet printer is provided for substrates of various natures, for example fabric, paper, plastic, glass, metal or other material suitable for inkjet digital printing, including a carriage device for holding any type of substrate to be printed, conformed to allow automatic adaptation to substrates of different shapes and thicknesses. Therefore, other modifications may be made to the printer and to the support and carriage device of the print substrate, and to the method of operation itself of the printer, without departing from the claims.

The invention claimed is:

1. An inkjet printer (10) for reproduction of pictures on a surface of a printable substrate (T), comprising:

an inkjet printing head (14), transversally movable along a longitudinally extending printing path;

a carriage device (17) for holding the substrate (T);

a control means (19) for moving the carriage device (17) along the printing path; and a programmable electronic control unit operatively connected to the printing head (14) and to the control means (19) for the carriage device (17);

in which the carriage device (17) comprises:

a slidable tray (31) conformed with coplanarly arranged reference edges (31') defining a printing plane;

a table (32) for supporting the substrate vertically movable with respect to the slidable tray characterised by comprising a lifting device for the support table (32), conformed to move the support table between an upper position above the reference edges (31') of the slidable tray and a lower position beneath said reference edges;

a biasing means operatively connected to move the support table towards said upper position above the reference edges of the tray;

the carriage device also comprising a removable stop frame (18) for the support table (32), and clamping means (51, 52) to disengageable connect the stop frame (18) to the slidable tray to retain a printable surface of the substrate (T) on the support table (32) in correspondence to the printing plane.

2. The inkjet printer according to claim 1, characterised in that the control means for moving the carriage device (17) comprises a driving belt (19) sliding along each reference edge (31') for the printing plane, operatively connected to a control motor (25), the stop frame (18) being provided with side wings (18') resting against said driving belts (19).

3. The inkjet printer according to claim 1, characterised in that the stop frame (18) has an annular side wall (50) downwardly extending, from said side wings (18').

4. The inkjet according to claim 1, further including a sensor (28) for detecting the presence of the carriage device (17), on the printing path.

5. The inkjet printer according to claim 1, characterised in that the lifting device (33) for the support table (32) comprises control means conformed to move the support table (32) with the substrate to be printed (T), towards and against the removable stop frame (18).

6. The inkjet printer according to claim 5, characterised in that the control means comprises an elastically biased thrust device (46).

7. The inkjet printer according to claim 5, characterised in that the control means for the support table (32) comprises an actuator and linear guides A.

8. The inkjet printer according to claim 1, characterised in that the printable substrate (T) being chosen from: fabric, plastic, paper, ceramic, glass, metal material, or their combination.

9. The inkjet printer according to claim 1, characterised in that the printable substrate (T) is a finished product having at least one printable surface.

10. A method for inkjet printing of pictures on a substrate (T), in which the picture is stored in the memory of an electronic control unit of an inkjet printer, in which the printer comprises a carriage device (17) movable along a printing path, wherein the carriage device comprises:

a slidable tray (31) conformed with coplanarly arranged reference edges (31') defining a printing plane;

a table (32) for supporting the substrate vertically movable with respect to the slidable tray characterised by comprising a lifting device for the support table (32), conformed to move the support table between an upper position above the reference edges (31') of the slidable tray and a lower position beneath said reference edges;

a biasing means operatively connected to move the support table towards said upper position above the reference edges of the tray;

a removable stop frame (18) for the support table (32), and clamping means (51, 52) to disengageable connect the stop frame (18) to the slidable tray to retain a printable surface of the substrate (T) on the support table (32) in correspondence to the printing plane, the method comprising the steps of:

positioning the substrate (T) to be printed on the support table (32) of the carriage device (17), with the support table (32) in a raised position compared with the reference edges (31 ') of the carriage device (17);

downwardly moving the support table (32) with the substrate (T) in a lowered position beneath the reference edges (31") of the carriage device (17) defining the printing plane;

locking the support table (32) with the substrate (T) in the lowered position by the removable stop frame (18) disengageably connected to the carriage device (17), against the reference edges (31'); and performing an inkjet printing phase on the substrate (T), entraining the carriage device (17) along the printing path, maintaining the support table (32) and the substrate (T) urged against the stop frame (18).

* * * * *